United States Patent [19]

Johnston

[11] 4,077,172

[45] Mar. 7, 1978

[54] EXTENSION LEG FOR TRUSSES FOR CONCRETE FORMING STRUCTURES AND THE LIKE

[76] Inventor: Ronald J. Johnston, 14 Regan Crescent, Georgetown, Ontario, Canada

[21] Appl. No.: 639,781

[22] Filed: Dec. 11, 1975

[30] Foreign Application Priority Data

Jul. 25, 1975 Canada ..... 232259

[51] Int. Cl.[2] ..... E04H 12/34; E04B 5/00

[52] U.S. Cl. ..... 52/111; 52/376; 52/289; 249/18

[58] Field of Search ..... 52/111, 116, 376, 289, 52/648, 262, 484, 645, 238, 263; 249/28, 188, 18

[56] References Cited

U.S. PATENT DOCUMENTS

| | | | |
|---|---|---|---|
| 3,787,020 | 1/1974 | Avery | 52/376 X |
| 3,823,523 | 7/1974 | Wells | 52/289 X |

FOREIGN PATENT DOCUMENTS

| | | | |
|---|---|---|---|
| 941,138 | 2/1974 | Canada | 52/111 |

*Primary Examiner*—Price C. Faw, Jr.
*Assistant Examiner*—Robert C. Farber
*Attorney, Agent, or Firm*—Donald E. Hewson

[57] ABSTRACT

In "flying forms" having a plurality of trusses — usually two — with a plurality of beams placed across the trusses and a deck placed on the beams, an extension leg for the truss is provided so that the working height of the truss may be nearly twice its flying height. The extension leg replaces a truss upright, and mounts using the same bolting arrangement therefor. The leg comprises inner and outer legs, where the outer leg is secured to the top and bottom chords of the truss, and the inner leg is telescopically engaged within the outer leg. The shape of the inner leg is such as to accommodate the bolts which secure the outer leg to the truss chords. Holes are formed in the inner and outer legs with predetermined spacings, and pairs of pins are used to lock the inner leg in any desired position with respect to the outer leg at substantially the desired height. A screw jack assembly is hingedly secured at the bottom of the inner leg, and may be locked in a downward position for pouring or locked in a swung-up position for flying.

10 Claims, 7 Drawing Figures

FIG. 4
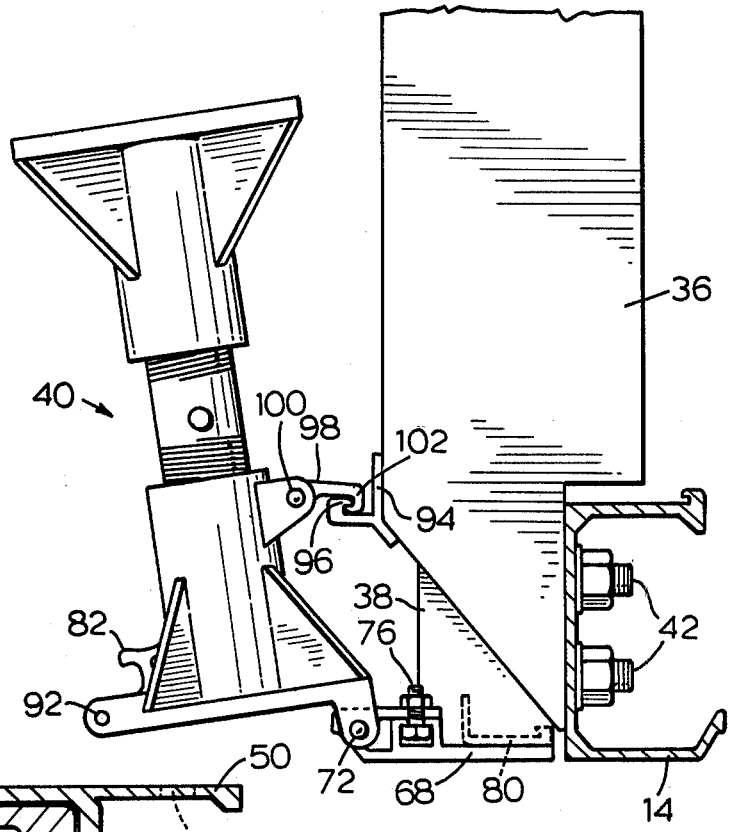
FIG. 5
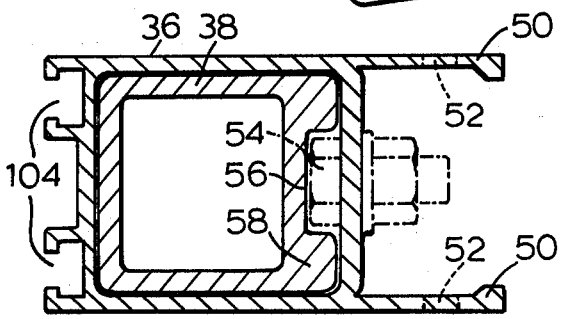
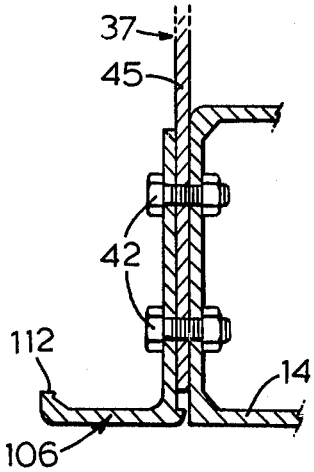
FIG. 7
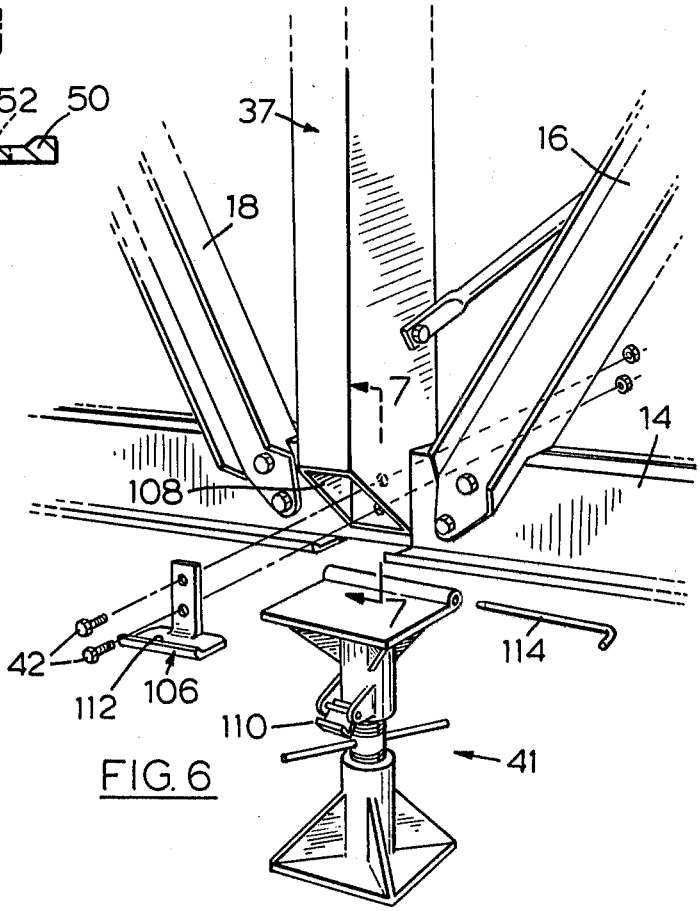
FIG. 6

EXTENSION LEG FOR TRUSSES FOR CONCRETE FORMING STRUCTURES AND THE LIKE

FIELD OF THE INVENTION

This invention relates to concrete forming structures-,and particularly to concrete forming structures which comprise at least a pair of trusses, a plurality of beams placed across the trusses and a deck placed on the beams, all of which is a "flying form" and is moved as a unitary structure for forming horizontal or substantially horizontal concrete floors or slabs. This invention provides an extension leg for such concrete forming structures, so that the flying height and the pouring height of the truss in the structure may vary by a factor of approximately two.

BACKGROUND OF THE INVENTION

Flying forms of the sort for which the extension leg assembly of the present invention is particularly useful are known, for example, from Canadian Patent No. 941,138 in the name of Peter J. Avery, issued Feb. 5, 1974 and granted to the assignee of the present application. In that patent, there is taught a concrete forming structure which comprises — in the usual form — a pair of trusses with a plurality of substantially parallel beams placed across the trusses, and a deck formed of a number of panels secured to the beams. The whole structure is bolted together, and is adapted so as to be flown from one position to another by being lifted by a suitable crane or other means. However, when such structures are placed for use in concrete forming, where the concrete floor or slab to be poured is placed on the upper surface of the deck, some adjustment must be provided both to assure that the upper surface of the deck is exactly at the correct height at all places, and also so as to be able to lower the deck away from the underside of the poured concrete slab after it has cured in order that the concrete forming structure may be removed and flown to its next working position.

In the previous patent, noted above, a screw jack was supplied and adapted to be fitted to the bottom chord of each truss at a place beneath a truss upright. Such arrangement was, of course, necessary so as to assure that loads transferred downwardly through the truss uprights and the truss diagonals to the bottom chord would be transferred directly to the supporting surface on which the trusses were standing.

However, in many cases it has been noted that it is desirable to have a wider adjustment of the height of the truss from its working height to its flying height. This may be, for example, particularly so as to accommodate greater than normal floor-to-ceiling heights as may be found in parking garages, commercial and office buildings, the lower floors of hotels where lobbies or convention floors might be accommodated, etc. Also, in some cases a spandrel beam is poured at the same time as a concrete slab or floor, so that it is necessary to reduce the height of the form by more than the usual amount in order to have it clear through the reduced height opening. In any event, it is sometimes necessary to provide an adjustment for the height of the truss of a concrete forming structure having a magnitude of adjustment with a factor of approximately two — i.e., where the working height may be as much as two times the flying height of the truss.

In not all cases, however, it is necessary or desirable — because of the additional expense — to have an extension leg in a truss; but when it is desired to have extension legs fitted to a truss, the substitution of the strandard truss uprights by the extension leg should be easily and quickly made, without the necessity for any additional drilling or rigging, especially in the field. Thus, when it is desired that extension legs be fitted to a truss for a flying form for use in horizontal or substantially horizontal concrete forming, so as to preclude the use of tables, movable dollies and the like, it is desirable to merely replace one part of the truss for each extension leg. By the same token, it is desirable that the extension leg be already fitted or adapted to be fitted with a screw jack assembly at its bottom end, in order that fine adjustment of the final height of the deck can be arranged in the usual manner.

One of the great advantages of using flying forms for concrete forming of the sort taught in the above-mentioned patent, is that such forms are generally made of extruded aluminum. Thus, very much larger forms with larger deck surfaces on which concrete can be poured are possible with aluminum concrete forming structures of the sort referred to than would be possible with steel or wooden structures. It follows, therefore, that it is desirable that the extension legs for such concrete forming structures should also be preferably formed of extruded aluminum rather than of structural steel tubing, I-beams, etc., in order that the amount of increased weight which is added to the concrete forming structure by the addition of extension legs be kept to a minimum.

It is also desirable that other attachments might be easily and quickly secured to the concrete forming structure by attaching them to bolt slots formed in the extension leg. Such additional attachment might be underslung beam forms or connection beams, outriggers, knee braces, etc. In any event, the provision of at least one bolt slot — and in the preferred embodiment, two bolt slots — on the outer face of the extension leg assembly can accommodate such attachments.

It has been noted that it is desirable to provide means whereby a screw jack assembly may be secured to the bottom end of the inner leg — which is the lower leg — of the extension leg assembly in such a manner that the screw jack assembly may be locked in a down position when it is supporting the concrete forming structure, or in a swung-up position for flying. Lock means are therefore provided on an extension leg assembly according to this invention whereby both positions of the screw jack assembly can be assured. The locking arrangement for the screw jack assembly when it is in its flying position is such that the center of gravity of the screw jack assembly assures engagement of the hooks which comprise the lock, as discussed in greater detail hereafter.

In general terms, the extension leg for concrete forming structures, provided by this invention, consists of a first, outer leg which has a back and a front surface, and which is secured to the top and bottom chords of the truss; and a second, inner leg also having front and back surfaces which is telescopically engaged within the first leg. Of course, an interior opening is formed axially within the first leg so as to accommodate the second leg, and the second leg is so shaped at its back surface as to accommodate those portions of the bolts which secure the upper leg to the top and bottom chords of the truss which are on the inside of the back face of the upper leg. pairs of holes are formed through the front and back surfaces of the inner leg, having predetermined spacing between them — in general, a plurality of holes where the same predetermined spacing exists between any adjacent pair thereof; and at least two holes are formed through the front and back surfaces of the outer leg so that a pair of pins can be inserted, one through each of the holes, to secure the legs against relative axial movement one to the other. (It should be noted that, for purposes of load bearing, a pair of pins is usually inserted through each of the legs when they are locked in position.)

BRIEF SUMMARY OF THE INVENTION

It is an object of this invention to provide an extension leg assembly for trusses used in concrete forming structures, where the extension leg assembly may have a screw jack assembly hingedly secured to its bottom end in such a manner that it may be locked either in a down position or a swung-up position.

A further object of this invention is to provide an improved extension leg assembly for trusses for concrete forming structures, where the extension leg assembly may be substituted for an upright which would normally be a part of the truss assembly.

A still further object of this invention is to provide extension leg assemblies for trusses which are such that additional attachments, cross-bracing, etc. may be secured to the extension leg assembly.

A feature of this invention is that all of the principle components of the improved extension leg assembly hereof are formed of extruded aluminum.

BRIEF DESCRIPTION OF THE DRAWINGS

These and other features, objects and advantages of this invention are more clearly described hereafter, in association with the accompanying drawings, in which:

FIG. 4 is a side view of the assembly shown in FIG. 2;

FIG. 5 is a cross-section of the extension leg assembly looking in the direction of arrows 5—5 in FIG. 3;

FIG. 6 is an exploded perspective view showing an attachment which is used when the inner leg is not being used; and FIG. 7 is a cross-section looking in the direction of arrows 7—7 in FIG. 6.

DESCRIPTION OF THE PREFERRED EMBODIMENTS

Figure 1:
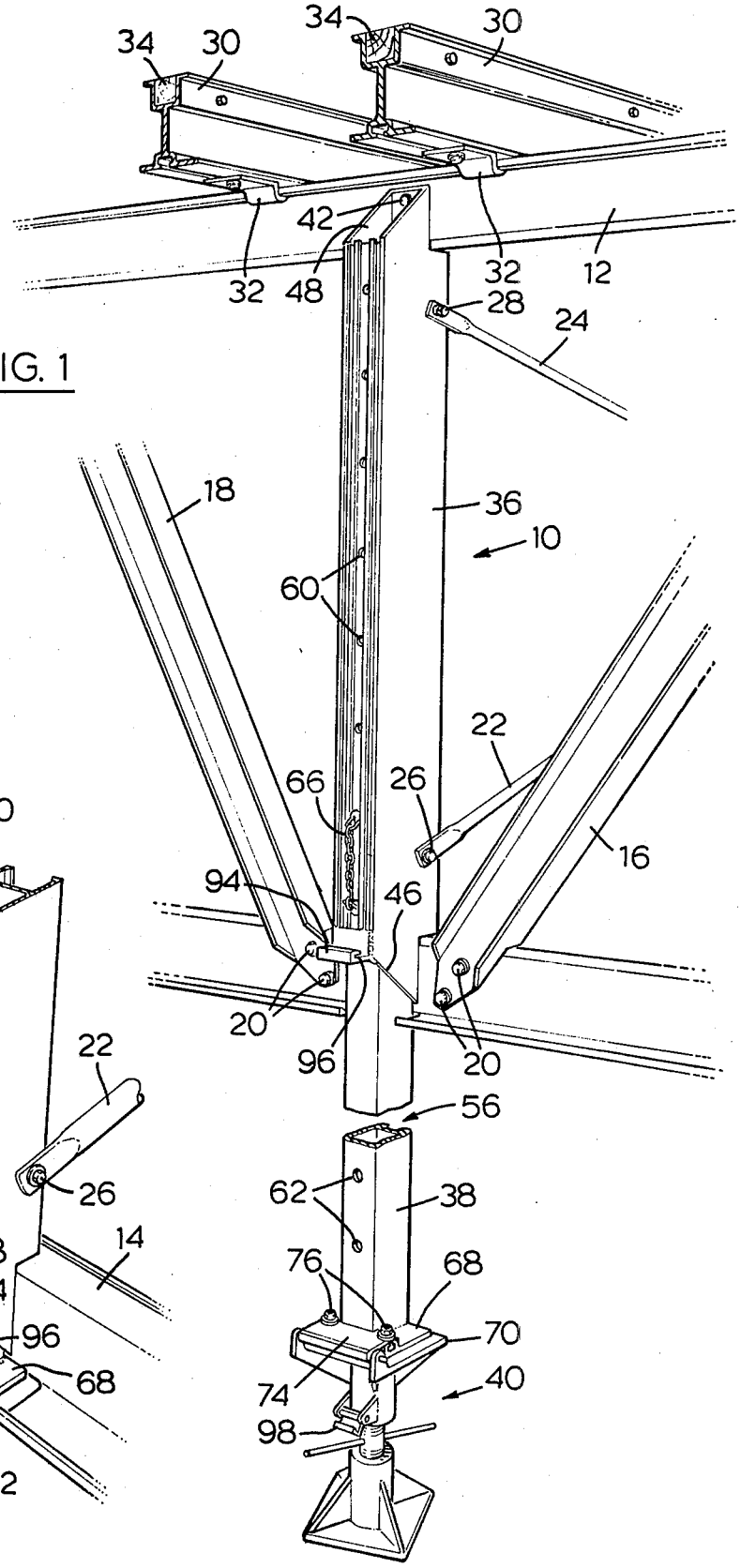
FIG. 1 is a perspective view of an extension leg according to this invention where the inner leg is extended and the screw jack assembly at its bottom end is in its down position.

The principle components which are illustrated in FIG. 1 include the extension leg assembly shown generally at 10, the upper end of which is secured to a top chord 12 and the lower end of which is secured to a bottom chord 14 of a truss. Diagonals 16 and 18 are secured by bolts 20 to the bottom chord; and cross-bracing 22 and 24 is secured by bolts 26 and 28 respectively to the extension leg assembly as discussed in greater detail hereafter. A plurality of beams 30 are secured to the upper chord 12 such as by clips 32 which are bolted to the bottom side of beams 30 with the bolt head secured in a bolt slot formed in the bottom of each beam 30. In the usual embodiment of the beams 30, wooden inserts 34 are secured in inverted top hat sections of the beams 30, and decking (not shown) is secured by driveable fastening means such as nails to the wooden inserts 34 and thus to the concrete forming structure which comprises the decking, the beams 30, and the trusses.

The principle components of the extension leg assembly according to this invention include a first, outer or upper leg 36 and a second, inner or lower leg 38. A screw jack assembly, shown generally at 40, is secured to the bottom end of the inner leg 38, as discussed in greater detail hereafter.

For purposes of this description, each of the outer and inner legs shall be considered to have front and back surfaces; the front surface being the surface which is normally on the outside of the truss — in other words, the surface which is facing generally to the left in FIGS. 1 to 6 — and the back surface being the opposed surface of each of the outer and inner legs — facing generally to the right in FIGS. 1 to 6.

It will be noted that the outer leg 36 is secured to the upper and lower chords 12 and 14 by bolts 42 which are passed through holes drilled in the back face 44 thereof. For ease of assembly of the outer leg 36 to the upper and lower chords 12 and 14, the upper and lower ends of the outer leg 36 are chamfered as at 48 and 46 respectively. It will be noted, therefore, that the outer leg 36 is assembled to the upper and lower chords 12 and 14 merely by removing four bolts 42 in the case of an assembly according to the illustrations, and that the outer leg totally replaces the normal truss upright which would usually be in that position. For that reason, the outer leg 36 is formed with a pair of wings 50 which extend rearwardly and vertically away from the back surface 44. At least one of the wings 50 has at least one hole 52 formed in it so that at least one of the bolts 26 and 28 for the cross-bracing members 22 and 24 may be removably attached to the wing 50 and thereby to the outer leg 36 of the extension leg assembly. In this way, even the cross-bracing 22 and 24 which is normally of standard lengths may be retained in position when an extension leg assembly 10 replaces a standard truss upright member.

The inner leg 38 is, as noted, telescopically engaged within the interior opening formed axially within the outer leg 36, and has an outer cross-section such as can be accommodated within that axial interior opening of the first leg 36. It will be noted that the bolts 42 by which the outer leg 36 is secured to the upper and lower truss chords 12 and 14, have heads 54 which are on the inside of the back surface 44 of the outer leg 36. In order that the inner leg 38 may be telescopically engaged within the outer leg 36, and also so that it may move upwardly and downwardly past the heads 54 of at least the lower bolts 42 in the bottom truss chord 14, a groove 56 is formed in the rear surface 58 of the inner leg 38. Thus, by this arrangement, it is possible to bolt the outer leg 36 to the upper and lower truss chords 12 and 14 without the necessity for drilling additional holes in the truss chords, and merely by undoing four bolts; and yet, at the same time, it is possible to have the inner leg 38 telescopically engaged within the outer leg 36 and able to move axially past the bolts 42.

At least two holes 60 are formed through the front and back surfaces of the outer leg — although, in the preferred embodiment, a plurality of holes is formed; and a plurality of holes 62 is formed through the front and back surfaces of the inner leg 38. The spacing between adjacent pairs of holes 60 and 62 is equal — or the spacing between holes 62 may be one half of the spacing between holes 60 — so that pairs of pins 64 may be inserted through the matching holes 60 and 62 in the outer and inner legs respectively in order that the legs 36 and 38 are secured against relative axial movement one to the other. Because of the very high loads which may be encountered in trusses having extension legs according to this invention, it is usual that pairs of pins 64 be used in order to carry the loading within the extension legs with the required factor of safety.

For convenience, the pins 64 may have a chain 66 attached to their heads so that they are kept in pairs; and indeed, the pins 64 may be loosely secured to the extension leg assembly 10 by such means as a wire (not shown) looped around the outer leg 36.

It will be noted that the outer and inner legs 36 and 38 can be adjusted relative one to the other and pins 64 passed through them so as to secure the extension leg assembly 10 with the overall height approximately at the required amount. However, in order that the height of the concrete forming structure may be accurately adjusted, it is necessary to provide screw jack means such as the screw jack assembly 40 beneath the truss. It is a feature of this invention that the screw jack assembly 40 is, indeed, capable of being secured to the bottom end of the inner leg 38 — and in most instances, the screw jack 40 is, indeed, secured to the bottom of the inner leg 38. Thus, it is necessary that the screw jack assembly 40 be capable of being locked in a down position such as illustrated in FIG. 1 when the truss is in place and load is being carried by the truss and screw jack assembly; and also that the screw jack assembly 40 be capable of being locked in a swung-up position when the concrete forming structure is being flown.

The particular manner in which the screw jack assembly 40 is secured to the bottom end of the inner leg 38 is by means of a bottom plate 68 which is secured to the bottom of the inner leg 38 such as by welding. A hinge plate 70 is secured to or formed in a first end of the screw jack assembly 40 — the upper end when the jack assembly is in its down position — and a hinge pin 72 connects with the first and second plate 68 and 70 so as to provide a hinging relationship of plate 70 to plate 68. The hinge pin 72 may be secured in place by such means as a cover plate 74 which is secured to the plate 68 by bolts 76; and for ease of attachment of the cover plate 74 to the plate 68, a bolt slot 78 may be formed in the upper surface of the plate 68. In any event, it will be seen that a hinged relationship of plates 70 and 68 exists around the pin 72.

Figure 3:
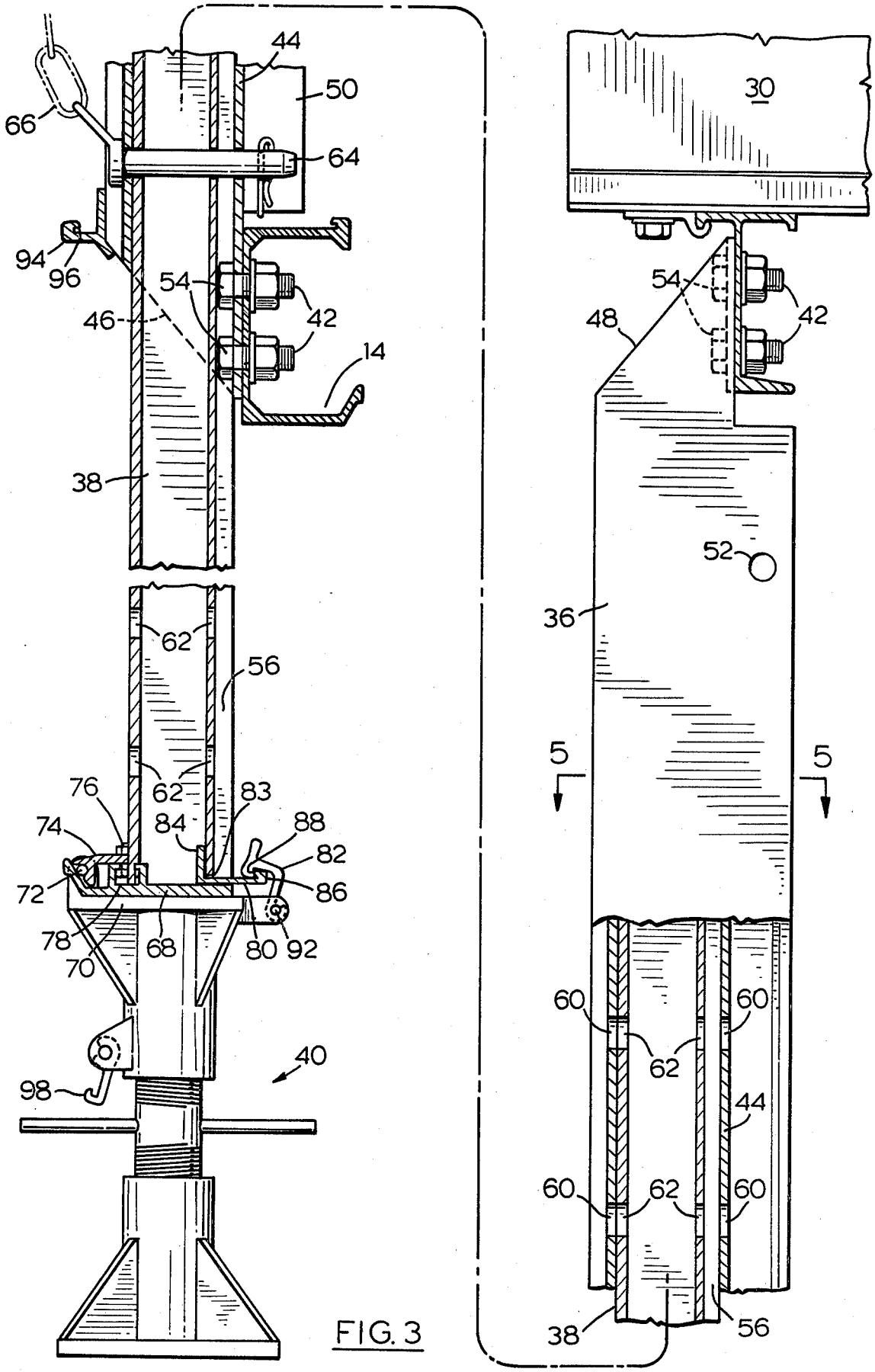
FIG. 3 is a partial cross-section of an extension leg assembly according to this invention.

The means whereby the screw jack assembly may be locked into its "down" position as shown in FIGS. 1 and 3, for example, include a slidable hook plate 80 and a hook arm 82. The slidable hook plate 80 is generally within the interior of the inner leg 38, and extends rearwardly therefrom through a slot 82 which is formed in the back surface of the leg 38 above the bottom plate 68. The hook plate 80 has stop means at its inner end, such as the upwardly facing portion 84, which precludes the complete removal of the hook plate 80 from the interior of the inner leg 38 through the slot 82. Likewise, stop means 86 are formed at the outer end of the slidable hook plate 80 so as to preclude complete insertion of the hook plate 80 into the interior of the inner leg 38 through the slot 82. In the preferred embodiment, the stop means 86 is formed so as to have a generally frontwardly facing hook 88 on the upper side of the outer end of the hook plate 80.

It should be noted that, as particularly indicated in FIG. 4, the hook plate 80 can be moved far enough forwardly so that the outer stop means 86 is located in the groove 56 formed in the rear face of the inner leg 38, in order that the inner leg 38 may be telescoped completely into the outer leg 36, past the bottom of the bottom chord 14.

The hook arm 82 is loosely engaged on a hinge pin 92; and a protrusion 90 is formed in the surface of the hook arm 82 which would engage the forwardly facing hook 88 of the hook plate 80. Because of the loose engagement of the hook arm 82 on the pin 92, a slight over-centre engagement of the protrusion 90 and hook 88 is accomplished, and when that relationship is accomplished the screw jack assembly 40 is locked in its down position.

Figure 2:
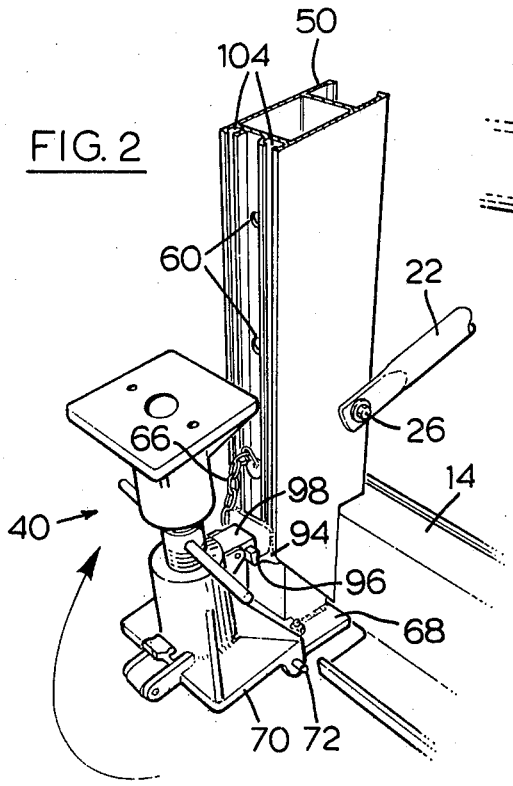
FIG. 2 is a perspective view of a portion of the extension leg assembly of FIG. 1, showing the inner leg telescoped into the outer leg and the screw jack asembly swung-up in the flying position.

The lock means whereby the screw jack assembly 40 may be locked in its swung-up position for flying the truss, is shown particularly in FIGS. 2 and 4. It will be noted that a frontwardly extending hook plate 94 is secured at the bottom end of the outer leg 36 at the front face thereof. The hook plate 94 has a rearwardly facing hook 96 formed therein. A second hook arm 98 is swingably secured to the screw jack assembly 40 at pin 100, and has a hook 102 formed at its outer end for engagement with the hook 96 of the hook plate 94. Because the hook arm 98 is on the screw jack assembly 40, and the hook plate 94 is on the outer leg 36, it is necessary that the inner leg 38 be totally retracted into the outer leg 36 as shown in FIGS. 2 and 4 in order that the hooking relationship of the hook arm 98 and hook 96 can be accomplished. At least one of the pins 64 is inserted through the appropriate hole 60 and 62 so as to secure the outer and inner legs 36 and 38 against relative axial movement one to the other; and if for some reason it is desired to use the concrete forming structure at standard height for perhaps one or two pours — a circumstance which makes removal of the extension leg not totally desirable — appropriate holes 62 and 60 are formed so that both pins 64 may be inserted and the loads taken up by the extension leg assembly 10 even with the inner leg 38 totally telescoped within the outer leg 36.

It will be noted that the relationship of the pin 72 and the hook 96 is such that the centre of gravity of the screw jack assembly 40 remains outside of the hook 96 on hook plate 94 when the extension leg assembly 10 is maintained substantially upright, so that secure locking relationship of the screw jack assembly 40 in its swung-up position is assured.

It has been stated that it may be desirable, from time to time, to attach other structures to the concrete forming structure having an extension leg assembly according to this invention, by attaching that other structure to the extension leg assembly. For that purpose, at least one and, in the usual case two, T-shaped axially extending slots 104 may be formed in the front surface of the outer leg 36. Underslung beams, outriggers, beam forms, knee braces, catwalks and other attachments can, therefore, be attached to the front face of each extension leg assembly 10 merely by inserting bolt heads in the bolt slots 104 and securing the attachment thereto. In the preferred embodiment, if any bolt slots are formed in the front surface of leg 36, two such bolt slots are formed so that bolts may be placed side-by-side in the attachment.

One other attachment which may be desired — and, indeed, is necessary in certain circumstances as discussed in greater detail hereafter — is a bottom chord filler indicated generally at 106 in FIGS. 6 and 7. The purpose of the bottom chord filler is to provide a means whereby a screw jack assembly 41 may be secured to the bottom chord 14 in the event that the inner leg 38 of the extension leg assembly according to this invention is not used, or where the extension leg assembly is replaced with a standard truss upright brace or leg which had originally been replaced by the extension leg assembly.

Thus, a gap or notch 108 appears in the bottom flange of the bottom chord 14 of the truss, in order to accommodate the inner leg 38 when it is used. When, however, it is not used, an outer leg or standard normal truss upright brace 37 is bolted in place on the bottom chord, using bolts 42. In the normal operation of the screw jack assembly 41, when it is not secured at the bottom end of an extension leg assembly, it is usually arranged to swing to its swung-up or flying position by being hinged on the inside of the bottom chord 14, and not at the outside of the truss as it is when an extension leg assembly according to this invention is used, and as illustrated in FIGS. 1 and 2. In order for the screw jack assembly 41 to be locked or secured in its down position for supporting relation to the truss, a hinged lock or hook plate 110 is provided, which cooperates with the outer lip 112 of the bottom chord 14. However, because the screw jack assembly 41 must be placed immediately beneath the truss upright brace or leg 37, in order to receive the loads transferred to it from that brace and also from the diagonal braces 16 and 18, it is necessary to secure the chord filler plate 106 to the bottom chord 14 and the inside back surface 45 of the upright brace 37, using bolts 42 as discussed above with respect to the outer leg 36 of the extension leg assembly according to this invention. The screw jack assembly 41 is thereby arranged to hinge or pivot about a pivot pin 114, when in place, and to be locked down by the cooperation of the hook plate 110 and lip 112 of the filler plate 106.

There has been described an extension leg assembly for trusses, where the extension leg assembly may be substituted for a standard upright member of the truss, merely by undoing and re-attaching the appropriate bolts; and without disturbing any other diagonal truss members. The major components of the extension leg assembly according to this invention are conveniently formed of extruded aluminum, so that the weight of the extension leg assembly does not add appreciably to the overall weight of a concrete forming structure to which the extension leg assembly is secured. In the preferred embodiment, a screw jack assembly is secured at the bottom of the extension leg, so that it may be locked down when the concrete forming structure is in position and also so that it may be swung up out of the way when the concrete forming structure is being flown. By such means, the concrete forming structure including the extension leg assembly is substantially self-contained; and the need to carry additional jack assemblies, bracing, etc. from one working position to the next is thereby obviated.

Other amendments, changes in detail, attachment arrangements and securing arrangements may, of course, be added to or substituted for similar items as discussed above, without departing from the spirit and scope of the appended claims.

The embodiments of the invention in which an exclusive property or privilege is claimed are defined as follows:

1. For use in construction of buildings and other structures wherein concrete slabs are poured on a supporting structure temporarily placed for that purpose; and where said supporting structure comprises at least one truss having top and bottom chords, a plurality of beams placed across said truss and a deck placed on said beams; an improved extension leg assembly for said truss, comprising:

a first, outer, leg having a box-like cross-section with a front and a back wall, and adapted to be removably secured to said top and bottom chords of said truss; and a second, inner, leg having a box-like cross-section with a front and a back wall, telescopically engaged within said first leg; where:

said first and second legs are each formed of extruded aluminum;

said first leg has a cross-section with an interior opening formed axially therein so as to accommodate said second leg;

said top and bottom chords of said truss are secured at the top and bottom ends, respectively, of said first leg, on the back wall thereof, by bolts passed through holes formed in said back wall, and portions of said bolts protrude into the axial interior opening of said first leg;

said second leg has an outer box-like cross-section such as can be accommodated within said axial interior opening of said first leg, with a groove formed in the outer surface of said back wall thereof and having sufficient width and depth so as to accommodate those portions of at least the bolts that secure said first leg to said bottom truss chord and which protrude into said axial interior opening of said first leg;

at least two holes having a predetermined axial spacing between them are formed through said front and back walls of said first leg; and a plurality of holes having the same predetermined axial spacing between pairs thereof are formed through said front and back walls of second leg, so that pairs of pins can be inserted through pairs of holes in said first and second legs to secure them against relative axial movement on to the other.

2. The extension leg assembly of claim 1, where a screw jack assembly is hingedly secured at the bottom end of said second leg, and is adapted to be locked down in a first position and locked in a swung-up second position.

3. The extension leg assembly of claim 2 where said screw jack assembly is hingedly secured at the bottom end of said second leg by means of a bottom plate secured to the bottom of said second leg, a first hinge plate secured to said bottom plate, a second hinge plate at a first end of said screw jack assembly, and a hinge pin co-acting with said first and second hinge plates so as to provide a hinging relationship of one to the other.

4. The extension leg assembly of claim 1 where at least one T-shaped, axially extending slot is formed in the front wall of said first leg.

5. The extension leg assembly of claim 3 where lock means are provided for locking said screw jack assembly in said first, locked down position, comprising:

a slidable hook plate within the interior of said second leg and extending rearwardly therefrom through a slot formed in said back wall thereof above said bottom plate;

said slidable hook plate having stop means at its inner end to preclude the complete removal thereof from the interior of said second leg through said slot;

stop means formed at the outer end of said slidable hook plate to preclude the complete insertion thereof into the interior of said second leg through said slot, and having a frontwardly facing hook on the upper side at the outer end thereof to co-act with a first hook arm swingably secured to said screw jack assembly;

said first hook arm being loosely engaged on a hinge pin therefor, and having a protrusion formed in the surface thereof which engages said hook on said hook plate so as to have an overcentre engagement therewith.

6. The extension leg assembly of claim 3 where lock means are provided for locking said screw jack assembly in said second, swung-up position, comprising:

a frontwardly extending hook plate fixedly secured at the bottom end at the front of said first leg, and having a rearwardly facing hook formed therein; and a second hook arm swingably secured to said screw jack assembly and having a hook formed at the outer end thereof for engagement with the hook of said hook plate.

7. The extension leg assembly of claim 1 where two T-shaped, axially extending slots are formed in the front wall of said first leg, one at each side thereof.

8. The extension leg assembly of claim 1 where said inner leg is substituted by a filler plate having a generally L-shaped configuration with the base of the L having a substantially identical configuration to the outer base flange of the bottom chord of said truss; and where said filler plate is secured to said bottom chord and to said first leg, on the front side of the back wall surface thereof, by bolts passed through holes formed therein.

9. The extension leg assembly of claim 1 where said back wall of said first leg has a pair of wings extending vertically therefrom at each side thereof, at least one of said wings having at least one hole formed therein so that a cross-bracing member may be removably attached thereto.

10. The extension leg assembly of claim 1 where a portion of the front wall of said first leg is removed at the bottom and top thereof so as to provide access from the front of said first leg to the bottom and top portions of the back wall thereof.

* * * * *